US005669273A

United States Patent [19]

Huang

[11] Patent Number: 5,669,273

[45] Date of Patent: Sep. 23, 1997

[54] SCREW DRIVER

[76] Inventor: Daniel Huang, 56, Min Sheng Street, Fengyuan, Taichung, Taiwan

[21] Appl. No.: 608,665

[22] Filed: Feb. 29, 1996

[51] Int. Cl.[6] ..... B25B 23/00

[52] U.S. Cl. ..... 81/438; 81/439

[58] Field of Search ..... 81/124.3, 437–439

[56] References Cited

U.S. PATENT DOCUMENTS 3,590,895 7/1971 Wirtanen ..... 81/438

5,528,963 6/1996 Wei ..... 81/438 X

*Primary Examiner*—James G. Smith

[57] ABSTRACT

A spanner type screw driver comprises a spanner device, a bit and a first and second rivets. The spanner device has a first spanner and a second spanner. The first spanner has a first hexagonal hole on the first head portion of the first spanner. The second spanner has a second hexagonal hole on the second head portion of the second spanner. The first hexagonal hole has six blunt corners. The second hexagonal hole has six blunt corners also. A tapered recess is disposed on the first hexagonal hole. A tapered recess is disposed on the second hexagonal hole. An elastic retaining ring is disposed on the tapered recesses. The first and second spanners are fastened together by rivets. The screw driver bit is inserted in the first hexagonal hole, the retaining ring and the second hexagonal hole.

7 Claims, 5 Drawing Sheets

SCREW DRIVER

BACKGROUND OF THE INVENTION

The invention relates to a screw driver. More particularly, the invention relates to a spanner type screw driver to replace a conventional spanner type screw driver.

Referring to FIGS. 1 to 4, a conventional spanner type screw driver has a spanner device 10, a sleeve 14, a U-shaped elastic plate 16, a bit 17 and two rivets 18 and 19. The spanner device 10 has a first spanner 12 and a second spanner 13. The first spanner 12 has a round hole 121 on the head portion of the first spanner 12, a first through hole 122 and a second through hole 123 on the handle portion of the first spanner 12. The second spanner 13 has a circular hole 131 on the head portion of the second spanner 13, a third through hole 132 and a fourth through hole 133 on the handle portion of the second spanner 13. The sleeve 14 is clamped by the first spanner 12 and the second spanner 13. The lower portion of the sleeve 14 is inserted in the circular hole 131. The upper portion of the sleeve 14 passes through the round hole 121. The sleeve 14 has a hexagonal recess hole 141. The cross-section of the hexagonal recess hole 141 has six sharp corners (as shown in FIG. 4). A U-shaped elastic plate 16 is inserted in the hexagonal recess hole 141. A screw driver bit 17 which has a hexagonal body and a tip for screwing a cross head (Philips head) of a screw is inserted in the hexagonal recess hole 141 to be positioned by the U-shaped elastic plate 16. The conventional spanner type screw driver has the following disadvantages. The distance A between the tip end of the screw driver bit 17 and the second spanner 13 is very long. If the distance A is longer than the spacing B of an article, the conventional spanner type screw driver cannot enter the spacing B. Thus the conventional spanner type screw driver becomes useless (as shown in FIG. 3). The screw driver bit 17 uses six sharp edges along six sharp corners to contact the inner periphery of the sleeve 14 (as shown in FIG. 4). Thus the peripheral engagement between the sleeve 14 and the screw driver bit 17 is limited to six edge lines. Therefore, the torsion of the conventional spanner type screw driver is limited also. The user may not be able to screw on a screw tightly with a conventional spanner type screw driver.

SUMMARY OF THE INVENTION

An object of the invention is to provide a spanner type screw driver which can shorten the distance between the tip of the screw driver bit and the second spanner.

Another object of the invention is to provide a spanner type screw driver which provide an excellent peripheral engagement between the sleeve and the screw driver bit.

DETAILED DESCRIPTION OF THE INVENTION

Figure 1:
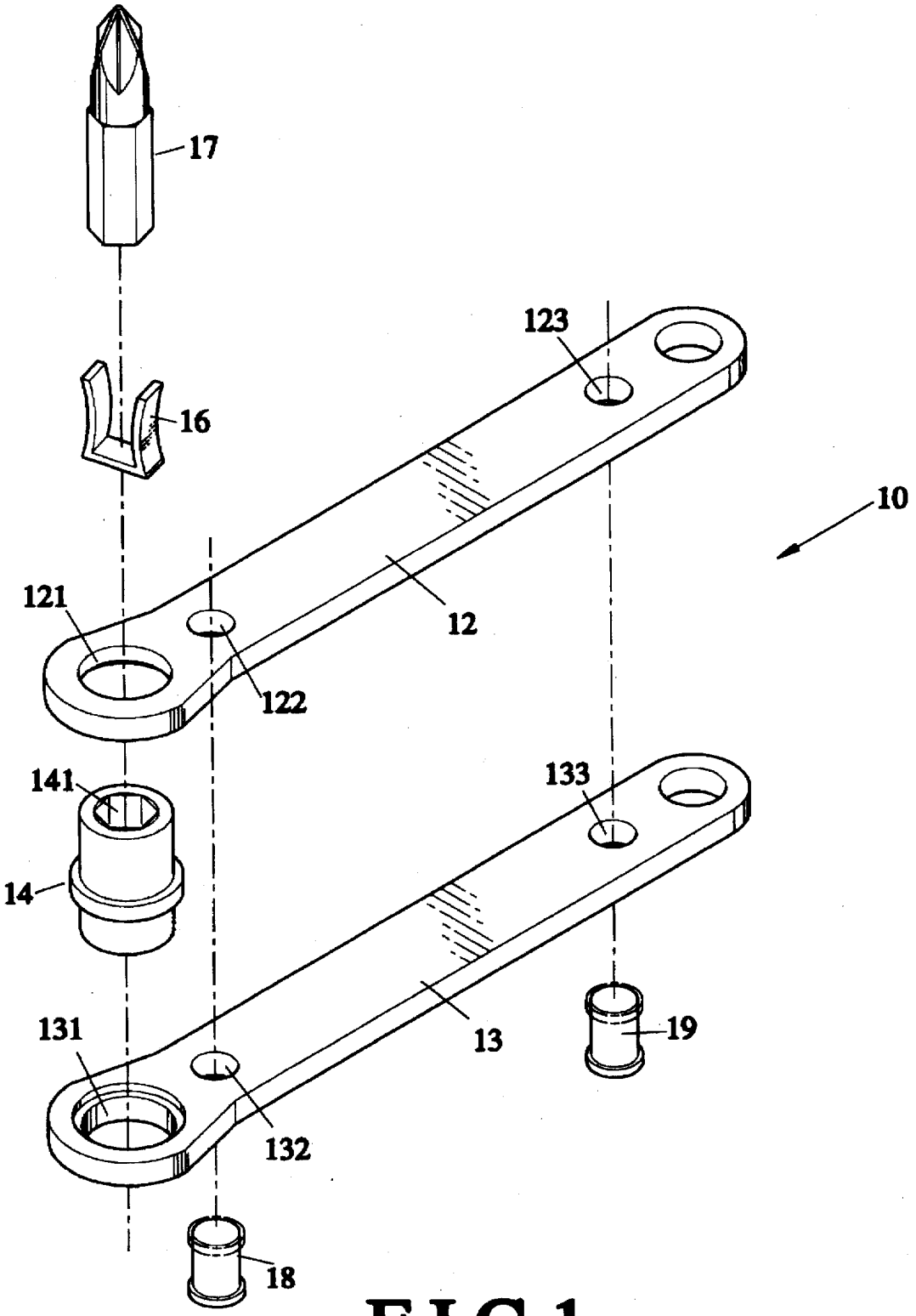
FIG.1 (Prior Art)
FIG. 1 is a perspective exploded view of a spanner type screw driver of the prior art.
Figure 4:
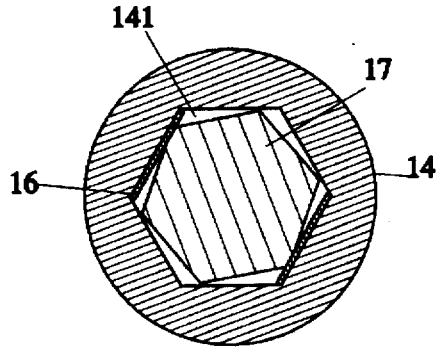
FIG.4 (Prior Art)
FIG. 4 is a cross-sectional view illustrating the engagement of a sleeve and a screw driver bit of the prior art.
Figure 2:
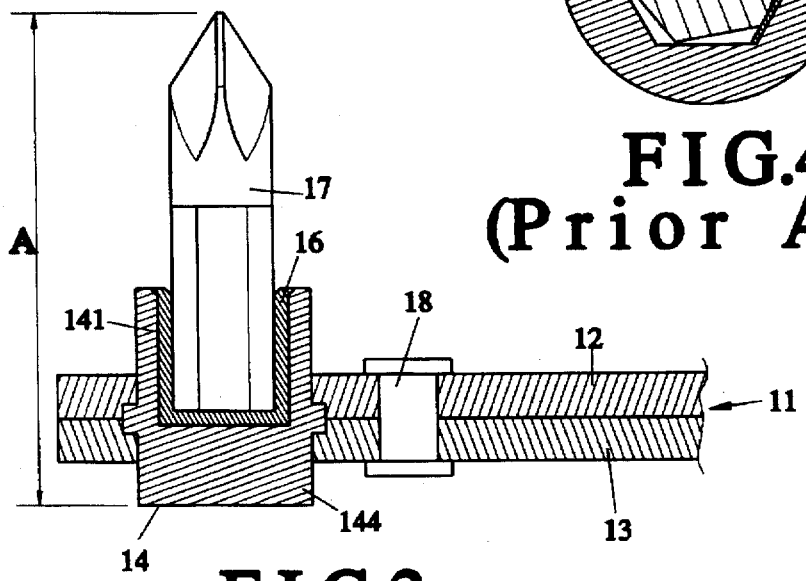
FIG.2 (Prior Art)
FIG. 2 is a partially cross-sectional, assembly view of a spanner type screw driver of the prior art.
Figure 3:
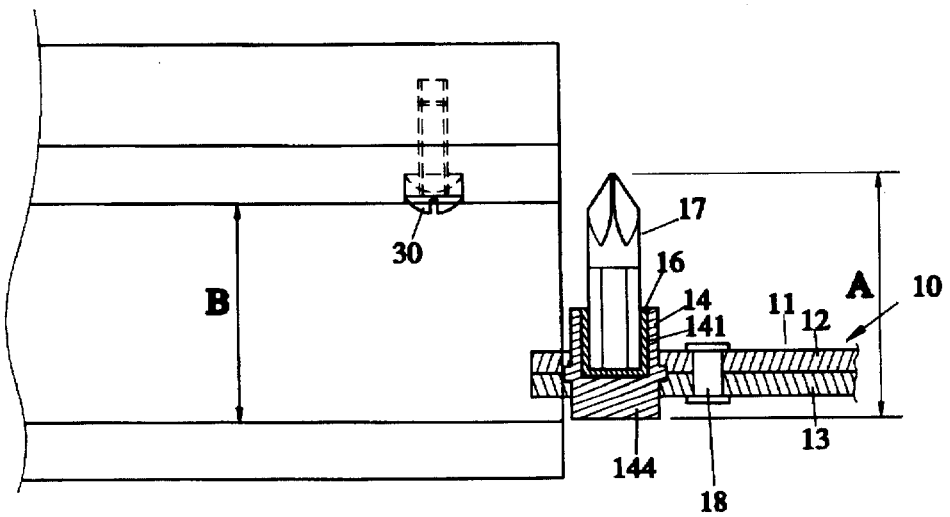
FIG.3 (Prior Art)
FIG. 3 is a schematic view illustrating the application of a spanner type screw driver of the prior art.
Figure 6:
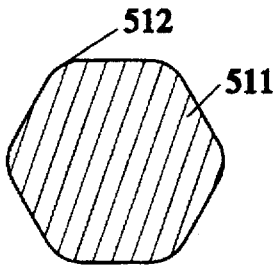
FIG. 6 is a cross-sectional view taken along line 6—6 in FIG. 5.
Figure 7:
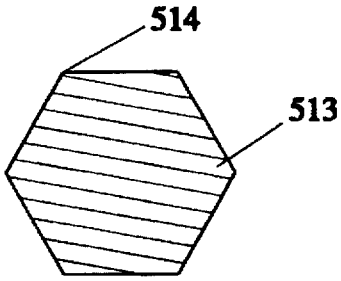
FIG. 7 is a cross-sectional view taken along line 7—7 in FIG. 5.
Figure 5:
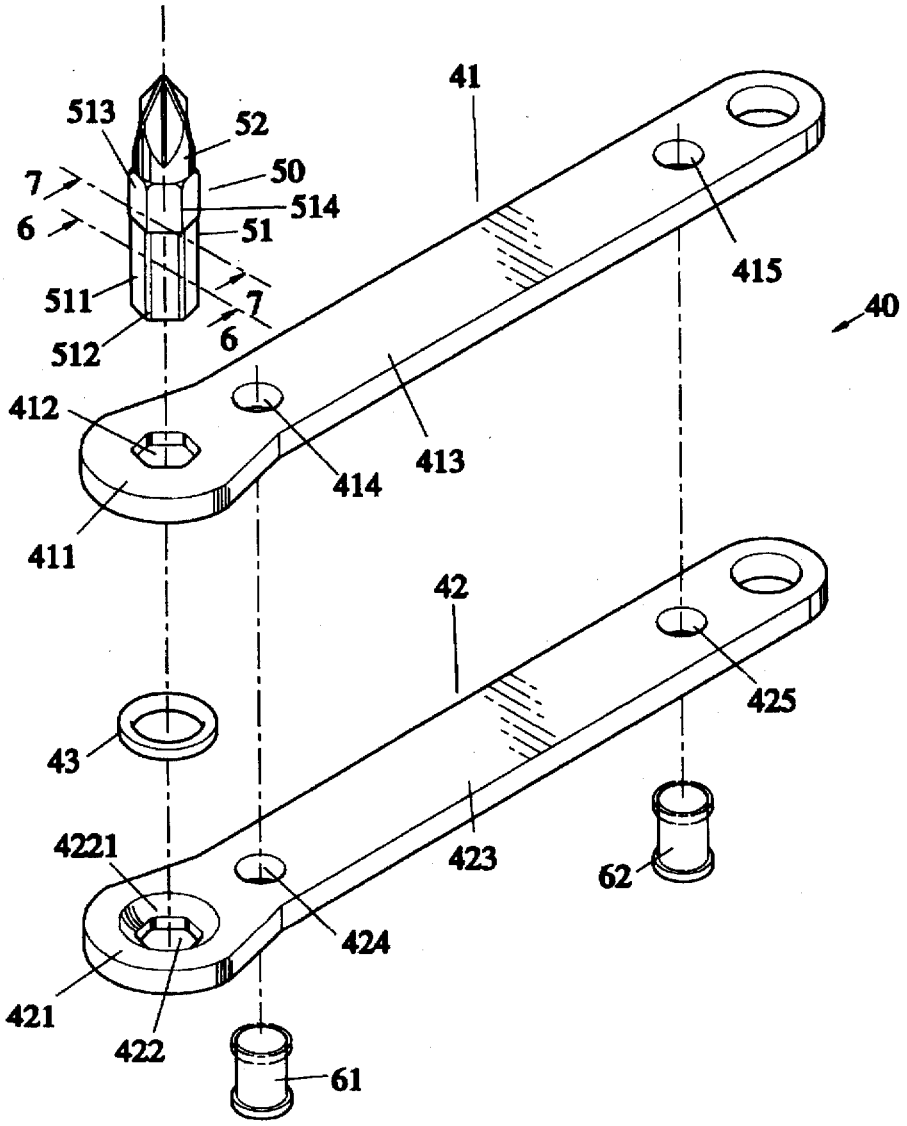
FIG. 5 is a perspective exploded view of a spanner type screw driver of a preferred embodiment in accordance with the invention.
Figure 8:
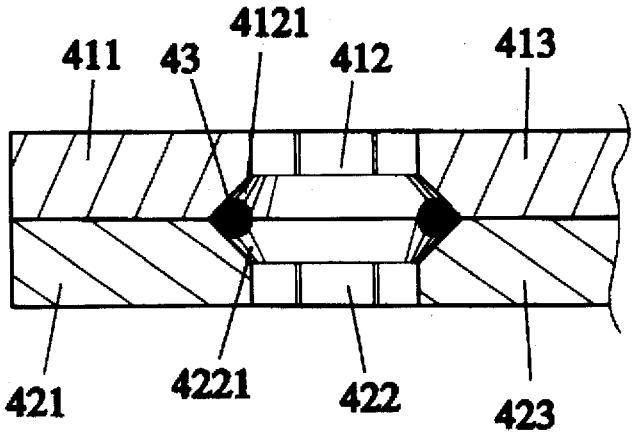
FIG. 8 is a partially cross-sectional view of a head portion of a spanner type screw driver.
Figure 9:
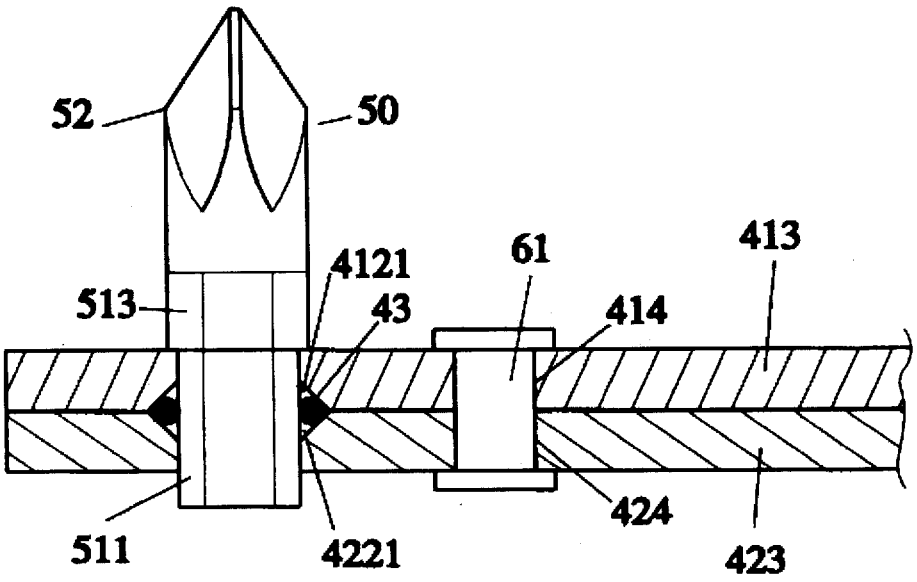
FIG. 9 is a partially cross-sectional, assembly view of a spanner type screw driver.
Figure 10:
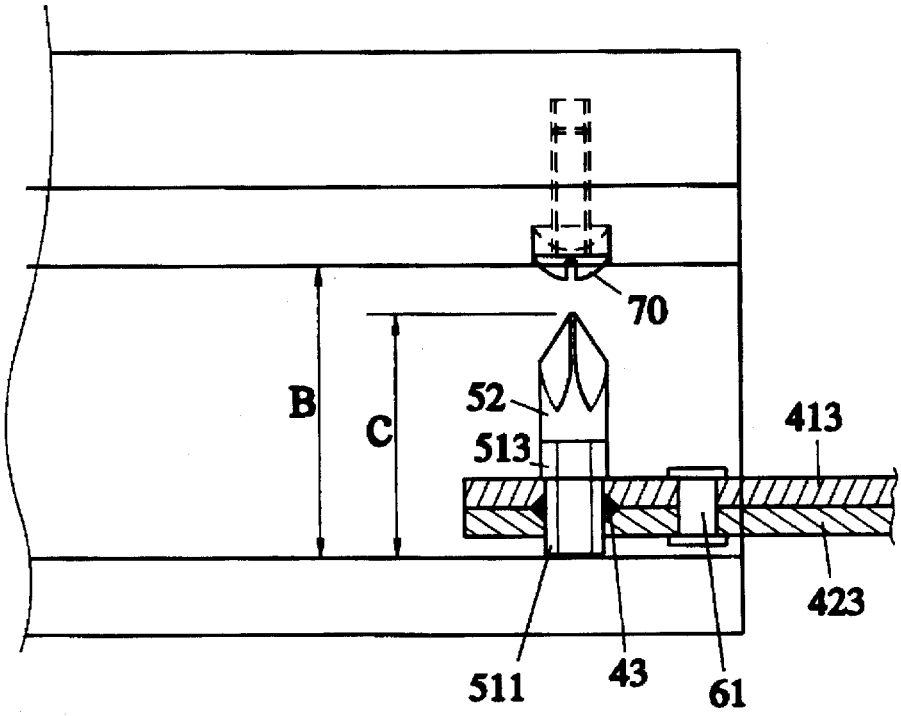
FIG. 10 is a schematic view illustrating the application of a spanner type screw driver.
Figure 11:
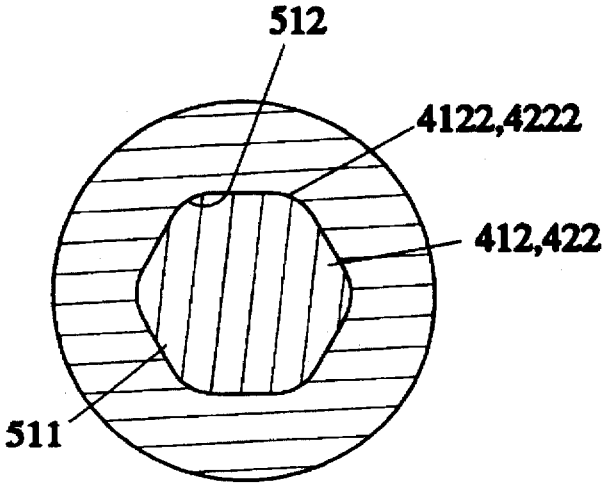
FIG. 11 is a cross-sectional view illustrating the engagement of a sleeve and a screw driver bit of a preferred embodiment in accordance with the invention.

Referring to FIGS. 5 to 9, a spanner type screw driver comprises a spanner device 40, a bit 50 and a first and second rivets 61 and 62. The spanner device 40 has a first spanner 41 and a second spanner 42 beneath the first spanner 41. The first spanner 41 has a first hexagonal hole 412 on the first head portion 411 of the first spanner 41, a first through hole 414 and a second through hole 415 on the first handle portion 413 of the first spanner 41. The second spanner 42 has a second hexagonal hole 422 on the second head portion 421 of the second spanner 42, a third through hole 424 and a fourth through hole 425 on the second handle portion 423 of the second spanner 42. The first hexagonal hole 412 has six blunt corners 4122 (as shown in FIG. 11). The second hexagonal hole 422 has six blunt corners 4222 also (as shown in FIG. 11). A first tapered recess 4121 which is formed on the first head portion 411 of the first spanner 41 is disposed on the first hexagonal hole 412 to communicate with the first hexagonal hole 412. A second tapered recess 4221 which is formed on the second head portion 421 of the second spanner 42 is disposed on the second hexagonal hole 422 to communicate with the second hexagonal hole 422. An elastic retaining ring 43 is disposed on the first and second tapered recesses 4121 and 4221. The first rivet 61 passes through the third through hole 424 and the first through hole 414 to fasten the first and second spanners 41 and 42 together. The second rivet 62 passes through the fourth through hole 425 and the second through hole 415 to fasten the first and second spanners 41 and 42 together. A screw driver bit 50 has a first section 511, a second section 513 and a third section 52. The first section 511 has six blunt corners 512. The second section 513 has six sharp corners 514. The third section 52 has a tip for screwing a cross head (Philips head) of a screw. The first section 511 of the screw driver bit 50 is inserted in the first hexagonal hole 412, the retaining ring 43 and the second hexagonal hole 422. Thus the retaining ring 43 can enclose the first section 511 tightly. Since the corners 512 of the first section 511 are blunt and the shapes of the corners 512 are the same as those of the first hexagonal hole 412 and the second hexagonal hole 422, the peripheral engagement between the screw driver bit 50 and the inner peripheries of the head portions 411 and 421 is fully close (as shown in FIG. 11). Therefore, the torsion of the spanner type screw driver is increased. Referring to FIG. 10, the distance C between the tip end of the screw driver bit 50 and the second spanner 42 is very short because the conventional sleeve is eliminated. Thus the distance C is always shorter than the spacing B of an article, and the spanner type screw driver can enter the spacing B easily.

It is an option to provide a retaining ring 43 which is made of magnetic material. It is another option to provide a first head portion 411 and a second head portion 421 which are made of magnetic material.

It is another option to provide a ratchet wrench type screw driver of the invention.

The invention is not limited to the above embodiment but various modification thereof may be made. Further, various changes in form and detail may be made without departing from the scope of the invention.

I claim:

1. A spanner type screw driver comprising:

a spanner device having a first spanner and a second spanner disposed beneath said first spanner;

said first spanner having a first hexagonal hole on a first head portion of said first spanner;

said second spanner having a second hexagonal hole on a second head portion of said second spanner;

said first hexagonal hole having six blunt corners;

said second hexagonal hole having six blunt corners;

a first tapered recess which is formed on said first head portion of said first spanner disposed on said first hexagonal hole to communicate with said first hexagonal hole;

a second tapered recess which is formed on said second head portion of said second spanner disposed on said second hexagonal hole to communicate with said second hexagonal hole;

an elastic retaining ring disposed on said first tapered recess and said second tapered recess;

said first and second spanners fastened together;

a screw driver bit inserted in said first hexagonal hole, said retaining ring and said second hexagonal hole.

2. A spanner type screw driver as claimed in claim 1, wherein said first spanner has at least a through hole to receive a rivet.

3. A spanner type screw driver as claimed in claim 1, wherein said second spanner has at least a through hole to receive a rivet.

4. A spanner type screw driver as claimed in claim 1, wherein said screw driver bit has a first section, a second section and a third section, said first section has six blunt corners, said second section has six sharp corners, and said third section has a tip for screwing a screw.

5. A spanner type screw driver as claimed in claim 1, wherein said retaining ring is made of magnetic material.

6. A spanner type screw driver as claimed in claim 1, wherein said first head portion is made of magnetic material.

7. A spanner type screw driver as claimed in claim 1, wherein said second head portion is made of magnetic material.

* * * * *